US006817891B2

(12) United States Patent
Wrede et al.

(10) Patent No.: US 6,817,891 B2
(45) Date of Patent: Nov. 16, 2004

(54) ARRANGEMENT FOR LABELING A SUBASSEMBLY MADE OF AT LEAST TWO PARTS

(75) Inventors: Bernhard Wrede, Lüdenscheid (DE); Klaus Hinteresch, Schwerte (DE); Christoph Schultz, Stuttgart (DE)

(73) Assignee: Leopold Kostal GmbH & Co. KG, Ludenscheid (DE)

( * ) Notice: Subject to any disclaimer, the term of this patent is extended or adjusted under 35 U.S.C. 154(b) by 0 days.

(21) Appl. No.: 10/639,337

(22) Filed: Aug. 12, 2003

(65) Prior Publication Data

US 2004/0074118 A1 Apr. 22, 2004

(30) Foreign Application Priority Data

Sep. 17, 2002 (DE) ..... 202 14 434 U

(51) Int. Cl.[7] ..... H01R 3/00
(52) U.S. Cl. ..... 439/491
(58) Field of Search ..... 439/491, 49, 490, 439/488, 719, 718, 638, 140, 676

(56) References Cited

U.S. PATENT DOCUMENTS 5,735,708 A * 4/1998 Arnett et al. ..... 439/491
5,807,139 A * 9/1998 Volansky et al. ..... 439/638
5,898,130 A * 4/1999 Tansi et al. ..... 174/66
6,139,356 A * 10/2000 Daoud ..... 439/491
6,688,910 B1 * 2/2004 Macauley ..... 439/491

FOREIGN PATENT DOCUMENTS

DE 39 28 270 A1 8/1989

* cited by examiner

*Primary Examiner*—J. F. Duverne
(74) *Attorney, Agent, or Firm*—Brooks Kushman P.C.

(57) ABSTRACT

An arrangement for labeling a subassembly having first and complimentary parts in which the subassembly labeling includes a label portion of each part. The first part has a first label portion and a window. The complimentary part is connectable with the first part in different spatial orientations to form different subassemblies. The complimentary part has second and third label portions in respective positions such that when the complementary and first parts are connected together in the first spatial orientation to form a first subassembly the second label portion is located behind the window and with the first label portion forms a label for the first subassembly, and such that when the complementary and first parts are connected together in the second spatial orientation to form a second subassembly the third label portion is located behind the window and with the first label portion forms a label for the second subassembly.

8 Claims, 2 Drawing Sheets

ARRANGEMENT FOR LABELING A SUBASSEMBLY MADE OF AT LEAST TWO PARTS

BACKGROUND OF THE INVENTION

1. Field of the Invention

The present invention relates to an arrangement for labeling a subassembly made of at least two parts in which the subassembly labeling includes a label put on each part, the subassembly including a first part and a complementary part with a label assigned to each part, with the first part having a recess arranged next to its label and the complementary part having its label in a position which, after the subassembly is put together, is located on the outside in both parts behind the recess of the first part.

2. Background Art

DE 39 28 270 C2 discloses a process for labeling technical devices manufactured in large numbers, for example subassemblies, each of which is made of at least two individual parts. For example, the subassembly may be made of a first part and a complementary part. The label of the subassembly, which itself is made of at least two individual label portions, includes a label portion which is arranged on the first part. The subassembly label is completed by another label portion assigned to the complementary part.

The first part and the complementary part are inserted into one another to assemble the subassembly. The first part is made in the form of a housing for the complementary part, and this first part has a window at the end of its label portion. The complementary part has its label portion located in a position which is behind the window in the first part after the two parts are put together. From the outside, the subassembly formed of the two parts then shows a completed label, which is composed of the label portion of the first part and of the label portion of the complementary part.

This previously known labeling system makes it possible, using a first part in the form of a housing, for example, for this part to be combined with different complementary parts to form different mass-produced subassemblies which can be distinguished from one another using the subassembly identification formed by the label portion of the first part and the label portion of the complementary part, without additional measures for identifying the subassembly. This document also discloses that a complementary part can be used for insertion in mirror-inverted housing parts serving as first parts, and for this purpose have a label or a label portion at positions that are correspondingly opposite to one another. However, this document does not disclose how variants of a subassembly formed of first and complementary parts would be made, and in particular, it does not disclose how different variants can be labeled with the previously known process without additional labeling measures.

SUMMARY OF THE INVENTION

Therefore, starting from discussed prior art, the present invention is based on the task of further developing an arrangement of the type mentioned in the Background Art in such a way that not only is it possible to make a variant, but that the different variants have different labels without this involving any additional measures.

This task is solved according to the present invention by the fact that the complementary part can be put together with the first part in at least two different spatial orientations to form subassemblies each having a different label, and that the complementary part has a different label portion at each of the complementary part's positions in which the label portion can be located behind a recess or window in the first part after the subassembly is put together.

The subject of this arrangement involves forming different variants of a subassembly by matching the two parts to one another in such a way that the complementary part can be put together with the first part in different spatial orientations to form the variants. Therefore, to form two variants, for example, it must be possible for the complementary part to be put together with the first part in two different spatial orientations.

These two spatial orientations can be realized, for example, by making it possible for the complementary part to be put together in two spatial orientations which differ from one another by 180°. In this arrangement the spatial orientation of the first part remains unchanged. Thus, this arrangement also makes it possible to make different subassemblies, as variants for example, and to use identical parts for this purpose. This reduces not only the inventory management, but in particular also reduces the tools used to create the large number of individual parts which would otherwise be usual, and the associated tool costs.

To label the different subassemblies or variants, the complementary part has different label portions at each of several positions or in each of several areas. A respective label portion of the complementary part becomes located behind the recess of the first part when the complementary part and the first part are assembled together in one possible configuration to form a subassembly or variant. The respective label portion of the complementary part, which appears in the recess or window of the first part, together with the label portion of the first part represent the label of the subassembly or variant. That is, these two label portions represent the subassembly label. Another respective label portion of the complementary part becomes located behind the recess or window of the first part when the complementary part and the first part are assembled together in a second possible configuration to form a second subassembly or variant. The second label portion of the complementary part appears in the recess or window of the second part and with the label portion of the first part represents the label of the second subassembly or variant. That is, these two label portions represent the second subassembly label.

The described arrangement is most suitable for forming and labeling a subassembly for forming a part of an electrical plug-and-socket connector having a contact element housing and a locking part with its locking bar for secondary locking of the contact elements inserted into the contact element housing. These elements are produced in large numbers, and inserted differently depending on the situation. These subassemblies are frequently needed in two variants, and this depends on the coding of the contact element housing.

BRIEF DESCRIPTION OF THE DRAWINGS

The present invention is described below using a sample embodiment, which makes reference to the attached figures. The figures are as follows.

DETAILED DESCRIPTION OF THE PREFERRED EMBODIMENT(S)

A contact element housing 1 for forming an electrical plug-and-socket connector has a label 2 portion on its front side. In the sample embodiment shown, label portion 2 serves not to label the contact element housing 1 but rather it forms part of a label along with the label portion borne by another part which is to be put together with the contact element housing. Contact element housing 1 has a second label portion 3 at a corresponding position on its back side. In the sample embodiment shown, label portion 2 of contact element housing 1 is a numerical identification and reads "01".

Figure 1:
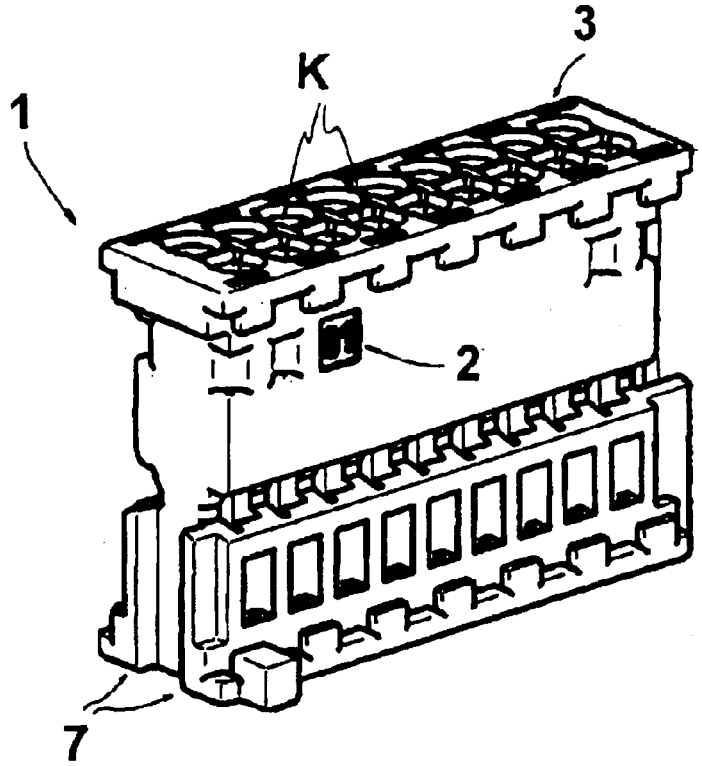
FIG. 1 illustrates a perspective view of a contact element housing which is a complementary part of an arrangement for labeling a subassembly formed by the contact element housing and a locking part.
Figure 2:
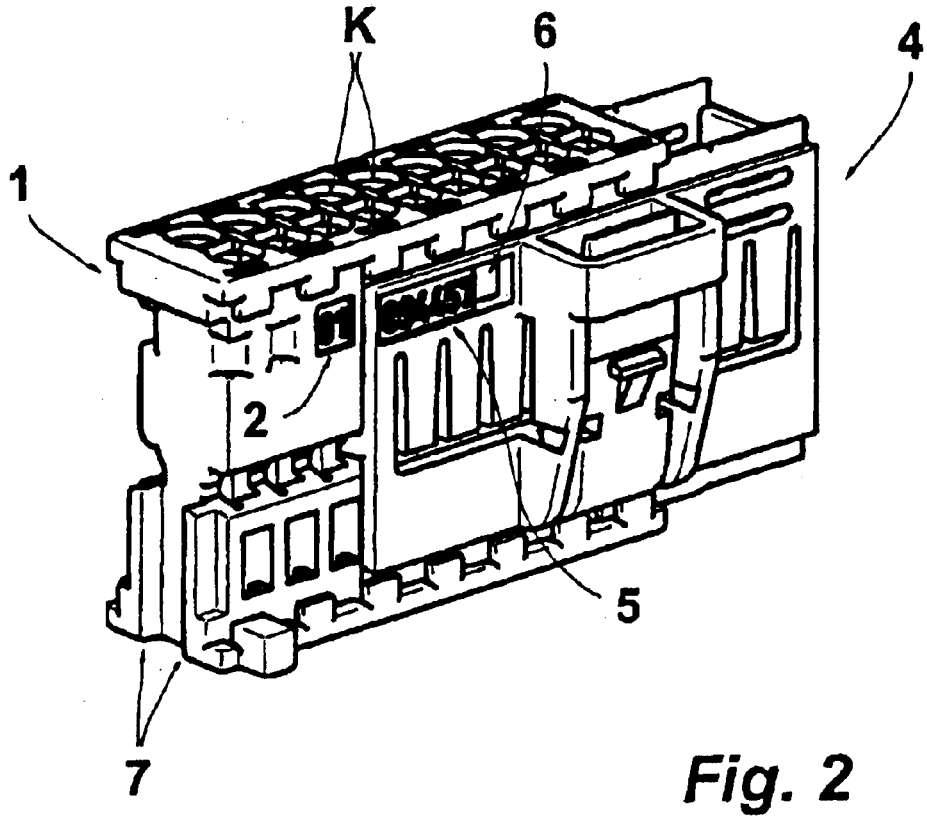
FIG. 2 illustrates the contact element housing shown in FIG. 1 with the locking part pushed on from one side of the contact element housing in an intermediate assembly position.

In the sample embodiment shown, locking part 4 represents the other part which forms a subassembly together with contact element housing 1. Among other things, locking part 4 provides secondary locking of contact elements inserted into chambers K of contact element housing 1. These contact elements can be in the form of plugs or as sockets. The view of FIGS. 1 and 2 illustrates contact element housing 1 with its rear cable exit, from which side the contact element housing has the contact elements inserted.

Locking part 4 is U-shaped. The U-shaped recess of locking part 4 can have contact element housing 1 pushed into it, as shown in FIG. 2. Locking part 4 has a label portion 5 on one side which, in the sample embodiment shown, is also a numerical label and reads "094457". Immediately next to one of the ends of label portion 5, locking part 4 has a recess or window 6. The top of contact element housing 1 is visible through window 6 as shown in FIG. 2 when the contact element housing is pushed far enough within the U-shaped recess of locking part 4.

If contact element housing 1 is pushed further into the U-shaped recess of locking part 4, label portion 2 of the contact element housing comes to rest behind window 6 such that when the two elements (contact element housing 1 and locking part 4) are assembled to form the subassembly, it is possible to see an overall label formed from the two label portions 2 and 5. Thus, label portions 2 and 5 themselves each represent a part or a portion of the label of the subassembly. Thus, the label of the subassembly formed in this way reads "09445701".

Figure 3:
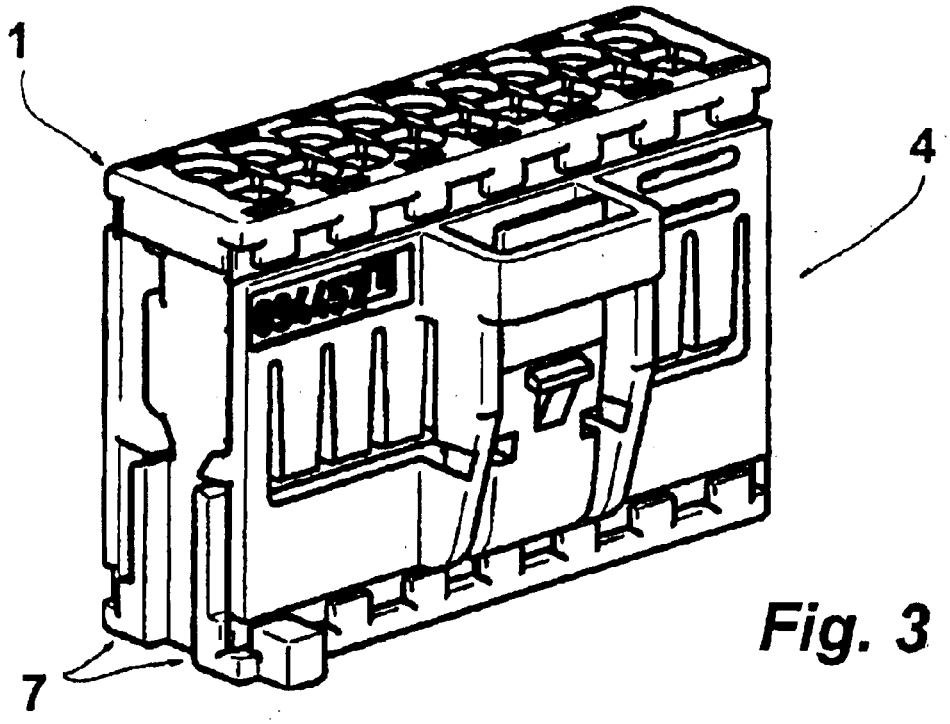
FIG. 3 illustrates the subassembly put together from the contact element housing and the locking part in a fully assembled position.

In the sample embodiment shown label portion 5 is the basic label portion, while label portions 2 and 3 assigned to contact element housing 1 represent a variant label. Depending on whether contact element housing 1 is inserted into the U-shaped recess of locking part 4 as shown in FIGS. 2 and 3, or whether contact element housing 1 is rotated by 180° and thus is inserted into locking part 4 with its other narrow side first, label portion 2 or the other label portion 3 is visible.

Figure 4:
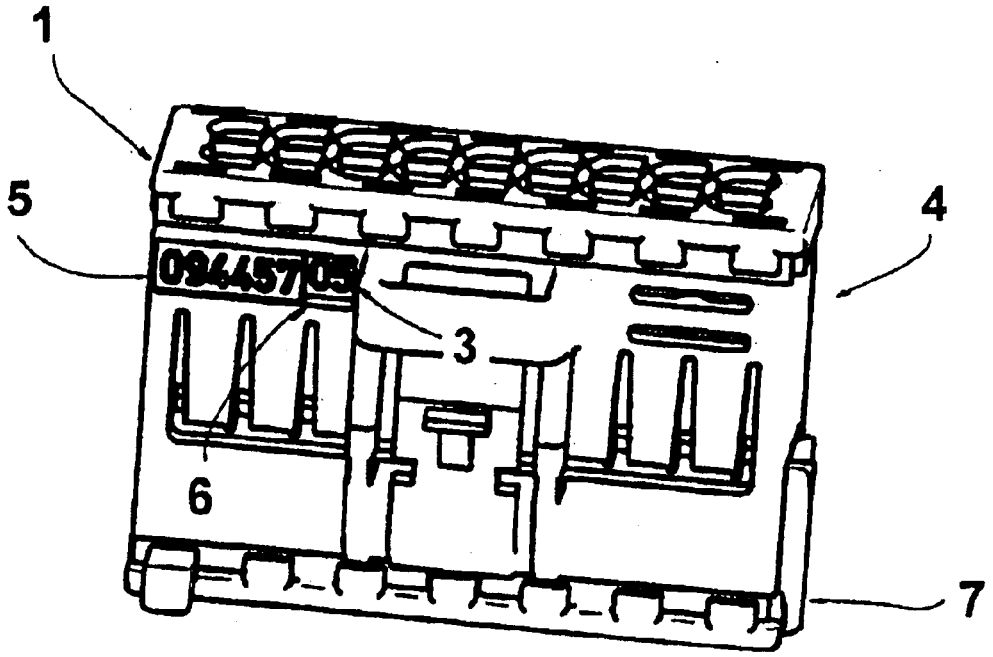
FIG. 4 illustrates a variant of the subassembly shown in FIGS. 1–3, in which the contact element housing is rotated by 180° with respect to the locking part.

FIG. 4 illustrates a variant of the subassembly formed from contact element housing 1 and locking part 4 in which the contact element housing has been inserted into the U-shaped recess of locking part 4 with its other narrow side. Thus, the two elements (contact element housing 1 and locking part 4) are put together by rotating the contact element housing by 180° about its longitudinal axis compared with the arrangement shown in FIGS. 2 and 3. Now window 6 of locking part 4 shows label portion 3 of contact element housing 1. Label portion 3 reads "05" and differs from label portion 2, so that this subassembly has a different overall label, namely "09445705", formed from label portion 5 and label portion 3 (each label portion being a partial label).

In the sample embodiment shown, different variants can be formed by assembling contact element housing 1 in different ways with respect to locking part 4. The different variants can be distinguished by the 180° coding 7 of contact element housing 1, with an assembly corresponding to FIGS. 2 and 3 having this 180° coding 7 on the left side of the subassembly, while the variant corresponding to FIG. 4 has the 180° coding 7 on the right side of the subassembly.

The description of the present invention makes it clear that it is possible, using simple means, to make different variants from identical elements and simultaneously label them. While embodiments of the invention have been illustrated and described, it is not intended that these embodiments illustrate and describe all possible forms of the invention. Rather, the words used in the specification are words of description rather than limitation, and it is understood that various changes may be made without departing from the spirit of the invention.

List of Reference Numbers

1 Contact element housing
2 Label portion
3 Label portion
4 Locking part
5 Label portion
6 Window
7 180° coding
K Chamber

What is claimed is:

1. An arrangement for labeling a subassembly having two parts in which the labeling of the subassembly includes a label portion of each part, the arrangement comprising:

a first part having a first label portion and a window arranged adjacent to the first label portion; and a complimentary part being connectable with the first part in different first and second spatial orientations to form a different subassembly in each spatial orientation;

the complementary part having second and third label portions in respective positions such that when the complementary part and the first part are connected together in the first spatial orientation to form a first subassembly the second label portion is located behind the window of the first part and together with the first label portion forms a label for the first subassembly, and such that when the complementary part and the first part are connected together in the second spatial orientation to form a second subassembly the third label portion is located behind the window of the first part and together with the first label portion forms a label for the second subassembly.

2. The arrangement of claim 1 wherein:

the window of the first part is formed by a recess of the first part.

3. The arrangement of claim 1 wherein:

the complementary part is connectable with the first part in the different first and second spatial orientations to form two subassembly variants.

4. The arrangement of claim 1 wherein:

the complementary part is rotated by 180° in the second spatial orientation with respect to the first spatial orientation.

5. The arrangement of claim 1 wherein:

the complementary part is a contact element housing and the first part is a locking part, the contact element housing and the locking part forming an electrical plug-and-socket connector assembly when connected together with one another to form one of the subassemblies.

6. The arrangement of claim 5 wherein:

the locking part bears a plug coding and the contact element housing accepts electric plug contacts.

7. An electrical plug-and-socket connector comprising:

a U-shaped locking bar having a first label portion and a window arranged adjacent to the first label portion; and a contact element housing being insertable at one end within the locking bar to form a first electrical plug-and-socket connector subassembly and being insertable at an opposite end within the locking bar to form a second electrical plug-and-socket connector subassembly;

the contact element housing having second and third label portions in respective positions such that when the contact element housing is inserted within the locking bar to form the first electrical plug-and-socket connector subassembly the second label portion is located behind the window of the locking bar and together with the first label portion forms a label for the first electrical plug-and-socket connector subassembly, and such that when the contact element housing is inserted within the locking bar to form the second electrical plug-and-socket connector subassembly the third label portion is located behind the window of the locking bar and together with the first label portion forms a label for the second electrical plug-and-socket connector subassembly.

8. The connector of claim 7 wherein:

the contact element housing has a plug coding which is located on the left side of the first electrical plug-and-socket connector subassembly and is located on the right side of the second electrical plug-and-socket connector subassembly.

* * * * *